US008393825B2

(12) United States Patent
Marsolek et al.

(10) Patent No.: US 8,393,825 B2
(45) Date of Patent: Mar. 12, 2013

(54) VIBRATORY COMPACTOR

(75) Inventors: John L. Marsolek, Watertown, MN (US); Eric S. Engelmann, Delano, MN (US)

(73) Assignee: Caterpillar Inc., Peoria, IL (US)

( * ) Notice: Subject to any disclaimer, the term of this patent is extended or adjusted under 35 U.S.C. 154(b) by 69 days.

(21) Appl. No.: 12/940,755

(22) Filed: Nov. 5, 2010

(65) Prior Publication Data

US 2012/0114416 A1 May 10, 2012

(51) Int. Cl.
*E01C 19/38* (2006.01)

(52) U.S. Cl. ..... 404/117

(58) Field of Classification Search ..... 404/117, 404/130, 128
See application file for complete search history.

(56) References Cited

U.S. PATENT DOCUMENTS

| | | | | |
|---|---|---|---|---|
| 3,516,341 | A | 6/1970 | Olsen | |
| 3,698,293 | A * | 10/1972 | Wagner | 404/122 |
| 3,871,788 | A | 3/1975 | Barsby | |
| 4,105,356 | A | 8/1978 | Loveless | |
| 4,221,499 | A | 9/1980 | Breitholz et al. | |
| 4,342,523 | A * | 8/1982 | Salani | 404/117 |
| 4,577,995 | A | 3/1986 | Sadahiro | |
| 4,927,289 | A | 5/1990 | Artzberger | |
| 5,248,216 | A | 9/1993 | Vural | |
| 5,397,198 | A | 3/1995 | Bertrand | |
| 5,984,572 | A * | 11/1999 | Mitsui | 404/117 |
| 6,132,133 | A | 10/2000 | Muro et al. | |
| 6,742,960 | B2 | 6/2004 | Corcoran et al. | |
| 6,829,986 | B2 | 12/2004 | Richter | |
| 7,213,479 | B2 | 5/2007 | Mitsui | |
| 7,354,221 | B2 | 4/2008 | Congdon | |

FOREIGN PATENT DOCUMENTS

JP 01119407 A 5/1989

OTHER PUBLICATIONS

"The principle of oscillation," Hamm AG, retrieved Jul. 20, 2010 from http://www.hamm.eu/en/technologien/oszillation/index.html.
"CS-323C and CP-323C Vibratory Soil Compactors," Caterpillar product brochure (2004).

* cited by examiner

*Primary Examiner* — Gary S Hartmann
(74) *Attorney, Agent, or Firm* — Leydig, Voit & Mayer

(57) ABSTRACT

A vibratory compactor machine includes a machine frame and a roller drum rotatably coupled to the frame and rotatable about a drum axis oriented generally traverse to the direction of travel of the machine. A vibration assembly is disposed inside the roller drum. The vibration assembly includes a first eccentric member and a second eccentric member rotatably disposed in the roller drum and rotatable about a respective first and second eccentric axes orientated perpendicularly to the drum axis. The roller drum rotates about the drum axis independently of the vibration assembly and the first and second eccentric members.

20 Claims, 5 Drawing Sheets

VIBRATORY COMPACTOR

TECHNICAL FIELD

This patent disclosure relates generally to a machine for compacting a material and, more particularly, to a vibratory compactor machine with roller drums for traveling over and inducing a vibratory force to a surface with the material to be compacted.

BACKGROUND

Compactors are machines used to compact initially loose materials, such as asphalt, soil, gravel, and the like, to a densified and more rigid mass or surface. For example, during construction of roadways, highways, parking lots and the like, loose asphalt is deposited and spread over the surface to be paved. One or more compactors, which may be self propelling machines, travel over the surface whereby the weight of the compactor compresses the asphalt to a solidified mass. The rigid, compacted asphalt has the strength to accommodate significant vehicular traffic and, in addition, provides a smooth, contoured surface that may facilitate traffic flow and direct rain and other precipitation from the road surface. Compactors are also utilized to compact soil or recently laid concrete at construction sites and on landscaping projects to produce a densified, rigid foundation on which other structures may be built.

Various types of compactors are known in the art. For example, some compactors include a rotatable roller drum that may be rolled over the surface to compress the material underneath. In addition to utilizing the weight of the roller drum to provide the compressive forces that compact the material, some compactors are configured to also induce a vibratory force to the surface. As can be appreciated, the vibratory forces assist in working or compacting the loose materials into a dense, uniformly rigid mass. To generate the vibratory forces, one or more weights or masses may be disposed inside the roller drum at a position off-center from the axis line around which the roller drum rotates. As the roller drum rotates, the off-center or eccentric position of the masses induce oscillatory or vibrational forces to the drum that are imparted to the surface being compacted. In some applications, the eccentrically positioned masses are arranged to rotate inside the roller drum independently of the rotation of the drum.

For example, U.S. Pat. No. 7,213,479 describes a vibratory mechanism in which two vibratory shafts are stored in a roll. The vibratory shafts include one or more eccentric weights disposed thereon and are configured to rotate inside the roll so that the eccentric weights generate an oscillating or vibratory force. Inside the roll, the vibratory shafts are parallel to each other and the rotational axis of the roll with the first and second vibratory shafts arranged 180° opposite each other with respect to the rotational axis of the roll. Further, the vibratory shafts cooperate with each other to vibrate the roll in various radial and tangential directions depending on the direction that the shafts are rotated.

As can be appreciated, it may be possible to vibrate or oscillate the roller drum in predetermined and particularized directions that improve the rate and degree of compaction of the material, that is, to focus the vibratory forces onto the surface being compacted. An opposing concern is to minimize or isolate the vibrations of the roller drum to avoid determinately effecting the operation of the compactor.

SUMMARY

The disclosure describes, in one aspect, a vibratory compactor machine including a machine frame and at least one cylindrical roller drum rotatably coupled to the machine frame so as to be rotatable about a drum axis that is oriented generally transverse to a direction of travel of the vibratory compactor machine. A vibration assembly is disposed inside the roller drum. The vibration assembly may include a first eccentric member and a second eccentric member where the first eccentric member is rotatably disposed in the roller drum about a first eccentric axis and the second eccentric member is rotatably disposed in the roller drum about a second eccentric axis. The first eccentric axis and the second eccentric axis are oriented generally perpendicular to the drum axis. The roller drum is configured to rotate about the drum axis independently of the vibration assembly including rotating independently with respect to the first and second eccentric members.

In a further aspect, there is disclosed a method of compacting a surface which involves a vibratory compactor machine that has a cylindrical roller drum in rolling contact with the surface and rotatable about a drum axis that is oriented generally perpendicular to a direction of travel of the machine. The method includes disposing a vibration assembly inside the roller drum where the vibration assembly includes a first eccentric member rotatable about a first eccentric axis and a second eccentric member rotatable about a second eccentric axis. The first eccentric axis and the second eccentric axis are also oriented generally perpendicular to the drum axis. The roller drum can be rotated independently about the vibration assembly. According to the method, a vibratory force can be induced to the roller drum generally along the direction of travel by rotating the first eccentric member and the second eccentric member within the roller drum.

In yet another aspect, the disclosure provides a vibratory compactor for compacting a surface which is configured for permanent or detactable connection with a machine adapted to travel over the surface. The vibratory compactor includes a cylindrical roller drum for rolling contact with the surface. The roller drum is rotatably coupled to a frame that is connectable to the machine. The roller drum can rotate about a drum axis oriented generally transverse to a direction of travel of the machine. A vibration assembly is disposed inside the roller drum and includes a first eccentric member rotatable about a first eccentric axis to produce a first eccentric force and a second eccentric member rotatable about a second eccentric axis to produce a second eccentric force. The first eccentric axis and the second eccentric axis are oriented generally perpendicular to the drum axis and to the direction of travel of the machine. The vibratory compactor also includes a bearing assembly supporting the vibration assembly and enabling respective independent rotation of the roller drum about the vibration assembly to substantially maintain perpendicular orientation of the first eccentric axis and the second eccentric axis with respect to the drum axis and the direction of travel of the machine.

BRIEF DESCRIPTION OF THE DRAWING(S)

DETAILED DESCRIPTION

This disclosure relates generally to a vibratory compactor machine having one or more roller drums that are in rolling contact with a surface to be compacted. Loose material, characterized as material which can be further packed or densified, is disposed over the surface. As the compactor machine travels over the surface, vibrational forces generated by the compactor machine and imparted to the surface, acting in cooperation with the weight of the machine, compress the loose material to a state of greater compaction and density. The compactor machine may make one or more passes over the surface to provide a desired level of compaction. In one intended application, the loose material may be freshly deposited asphalt that is to be compacted into roadways or similar hardtop surfaces. However, in other applications, the material may be soil, gravel, sand, land fill trash, concrete or the like.

Figure 1:
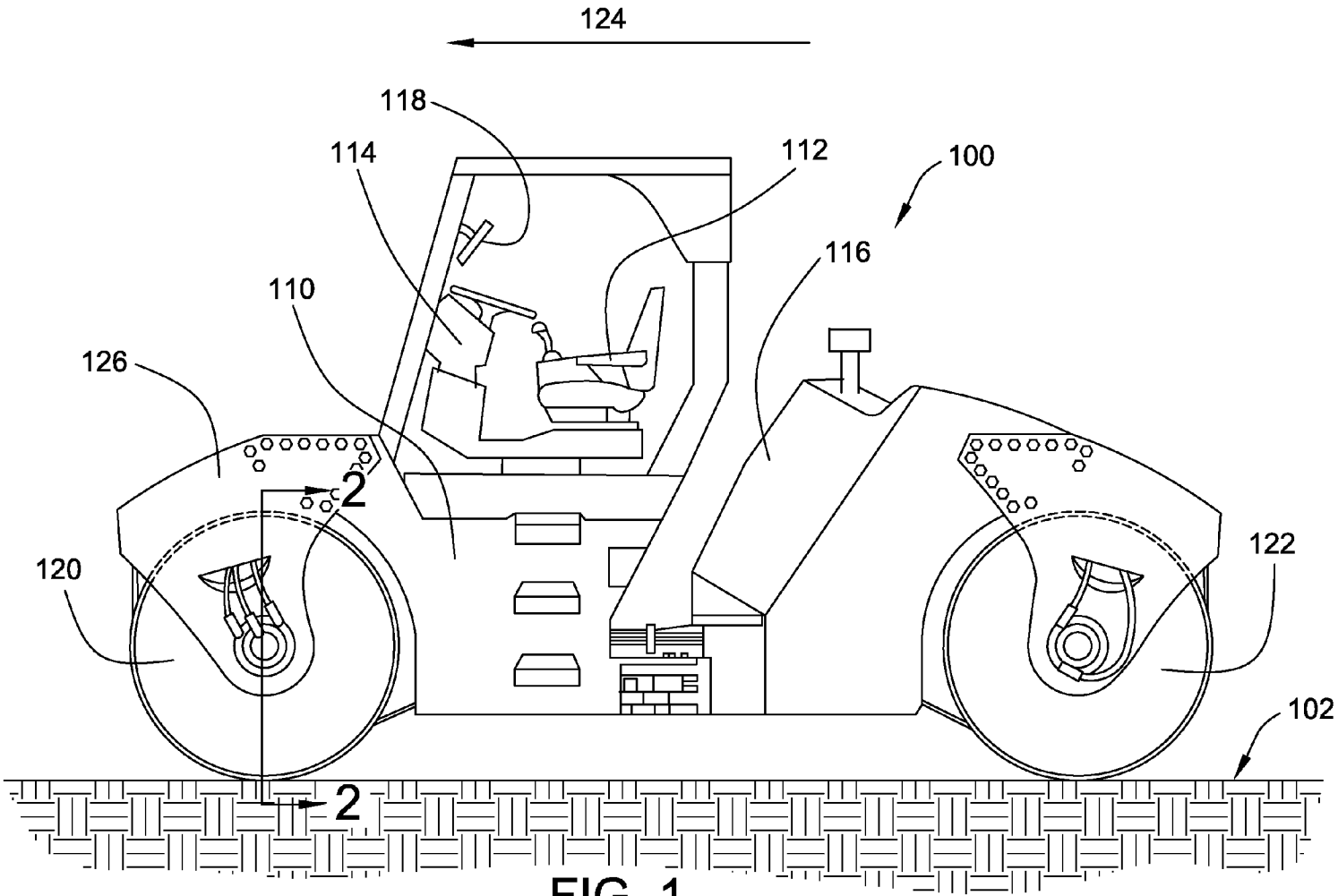
FIG. 1 is a side plan view of a vibratory compactor machine including one or more roller drums that are in rolling contact with a surface to be compacted.

Referring to FIG. 1, there is illustrated a compactor machine 100 of the self-propelled type that can travel over a surface 102 under its own power. The compactor machine 100 includes a body or frame 110 that inter-operatively connects and associates the various physical and structural features that enable the compactor machine to function. These features may include an operator's cab 112 that is mounted on top of the frame 110 from which an operator may control and direct operation of the compactor machine 100. Accordingly, a steering feature 114 and similar controls may be located within the operator's cab 112. To propel the compactor machine 100 over the surface 102, a power system 116 such as an internal combustion engine can also be mounted to the frame 110 and can generate power that is converted to physically move the machine. One or more other implements may be connected to the machine. Such implements may be utilized for a variety of tasks, including, for example, loading, lifting, brushing, and may include, for example, buckets, forked lifting devices, brushes, grapples, cutters, shears, blades, breakers/hammers, augers, and others.

To facilitate control and coordination of the compactor machine 100, the compactor machine can include an onboard controller 118 such as an electronic control module that includes a microprocessor or other appropriate circuitry and can include memory or other data storage abilities. The main unit of the controller 118 can be located in the operator's cab 112 for access by the operator and can communicate with the steering feature 114, the power system 116 and with various other sensors and controls on the compactor machine. While the controller 118 illustrated in FIG. 1 is represented as a single unit, in other embodiments the controller may be distributed as a plurality of distinct but interoperating units.

To enable physical motion of the compactor machine 100, the illustrated machine includes a first roller drum 120 and a second roller drum 122 that are in rolling contact with the surface 102. For reference purposes, the compactor machine 100 can have a typical direction of travel indicated by arrow 124 such that the first roller drum 120 may be considered the forward roller drum and the second roller drum 122 considered the rearward roller drum. The forward and rearward roller drums 120, 122 can be cylindrical structures that are rotatably coupled to and can rotate with respect to the frame 110. Because of their forward and rearward positions and their dimensions, the forward and rearward roller drums 120, 122 support the frame 110 of the compactor machine (100) above the surface 102 and allow it to travel over the surface. The roller drums 120, 122 are oriented generally traverse or perpendicular to the direction of travel 124 of the compactor machine 100. It should be appreciated that because the compactor machine 100 is steerable, the forward direction of travel 124 may change bearing during the course of operation but can be typically assessed by reference to the direction of movement of the forward roller drum 120. In the illustrated embodiment, to transfer motive power from the power system 116 to the surface 102, the power system can operatively engage and rotate the rearward roller drum 122 through an appropriate power train.

Figure 2:
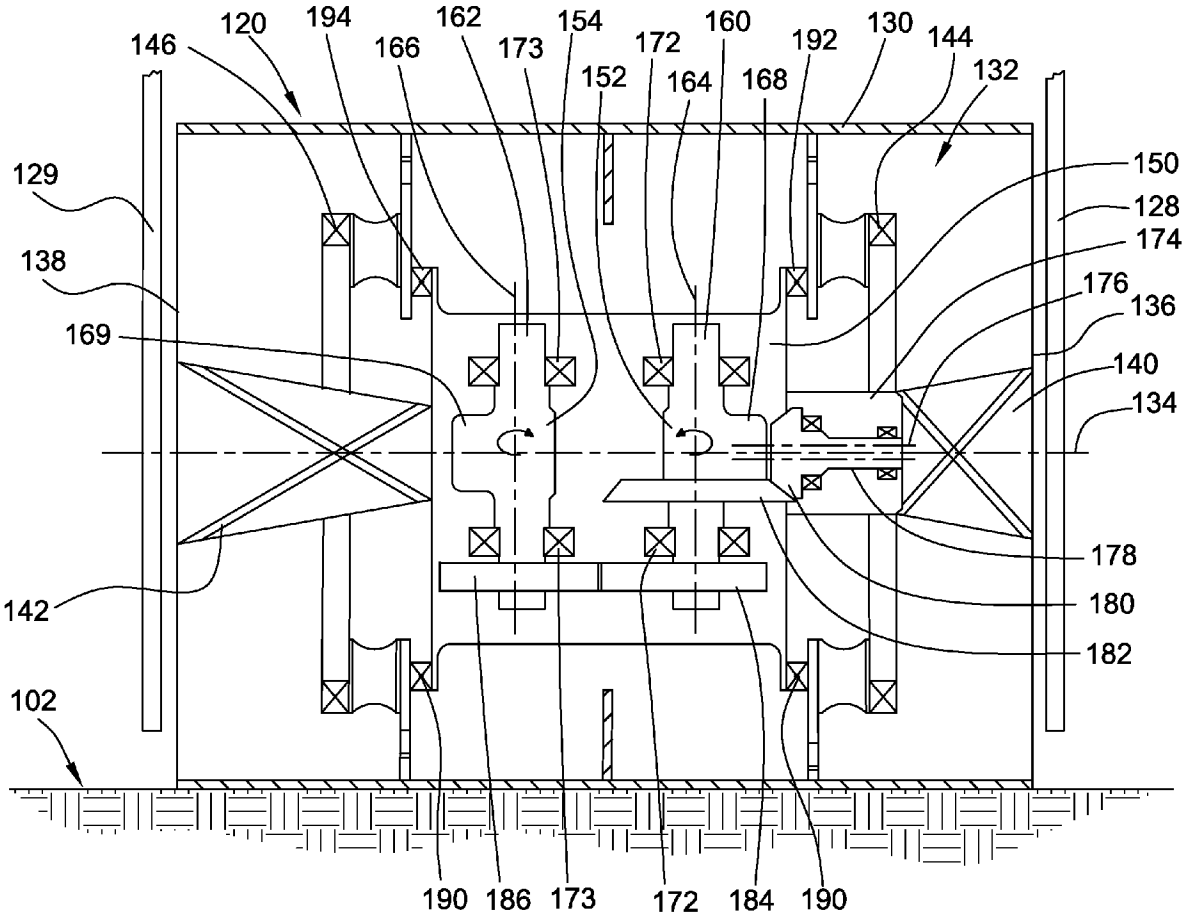
FIG. 2 is a cross-sectional view of the roller drum taken along lines 2-2 of FIG. 1 that illustrates an embodiment of an internal arrangement of the roller drum configured to generate vibratory forces.

Referring to FIG. 2, there is illustrated the interior of the first roller drum 120, however, it will be appreciated that the second roller drum 122 can have the same or different construction. In particular, the first roller drum 120 is an elongated, hollow cylinder with a cylindrical drum shell 130 that encloses an interior volume 132. The cylindrical roller drum 120 extends along and defines a cylindrical drum axis 134. To withstand being in rolling contact with and compacting of the surface 102, the drum shell 130 can be made from a thick, rigid material such as cast iron or steel. While the illustrated embodiments shows the surface of the drum shell 130 as having a smooth cylindrical shape, in other embodiments, a plurality of bosses or pads may protrude from the surface of the drum shell to, for example, break up aggregations of the material being compacted. The axial length of the cylindrical roller drum 120 is delineated between a first side or first end 136 and an opposite second side or second end 138. To enable the roller drum 120 to roll with respect to the surface 102, the roller drum may be rotatably coupled with the frame 110 of the compactor machine 100. To accomplish this, as illustrated in FIGS. 1 and 2, the roller drum 120 is supported between a bifurcated flange 126 having a first flange leg 128 and a second flange leg 129 extending proximate to the first and second ends 136, 138 such that the drum axis 134 is horizontal with respect to the surface 102.

To cause the roller drum 120 to vibrate and impart compacting forces to the surface 102, a vibration assembly 150 that includes the components of a mechanical vibratory system may be disposed inside the interior volume 132 of the roller drum. The vibration assembly 150 is located approximately at the center of the interior volume 132 between the first end 136 and the second end 138 of the roller drum 120. The vibration assembly 150 includes a first eccentric member 152 and a second eccentric member 154 that can rotate with respect to each other to generate a vibratory force within the roller drum 120. The first and second eccentric members 152, 154 may be substantially identical and may include a respective first elongated eccentric shaft 160 and a second elongated eccentric shaft 162 that define a respective first eccentric axis 164 and a second eccentric axis 166. Formed mid-length along the first eccentric shaft 160 is a first eccentric mass 168 that is offset or eccentric from the first eccentric axis 164. A similar second eccentric mass 169 protrudes from the second eccentric shaft 162 so as to be offset from the second eccentric axis 166. The eccentric masses 168, 169 can have equal mass and an equal offset distance from their respective eccentric axes 164, 166. The first and second eccentric members 152, 154 can be made from any suitable material that is sufficiently rigid such as steel or iron.

The first and second eccentric members 152, 154 are arranged such that their first and second eccentric axes 164, 166 are generally parallel to each other. The first and second eccentric members 152, 154 also are oriented vertically within the interior volume 132 of the roller drum 120 so that the first and second eccentric axes 164, 166 are perpendicular to the drum axis 134 and are also generally perpendicular to the surface 102. The first and second eccentric members 152, 154 can be axially spaced apart from each other along the drum axis 134 with the first eccentric member disposed toward the first end 136 of the roller drum 120 and the second eccentric member disposed toward the second end 138. The first and second eccentric members 152, 154 may also be oriented such that the first and second eccentric masses 168, 169 are vertically aligned with the drum axis line 134.

To support the vertically oriented first and second eccentric members 152, 154 in the interior volume 132 of the roller drum 120, the vibration assembly 150 can included a cage-like framework 170. To enable the first eccentric member 152 to rotate within the roller drum 120, a first set of shaft bearings 172 can be provided at the top and bottom of the first eccentric shaft 160 and can rotatably connect the first eccentric member with the framework 170. A second set of shaft bearings 173 can be similarly provided at the top and bottom of the second eccentric shaft 162 to rotatably connect the second eccentric member 154 to the framework 170.

To cause or drive rotation of the first and second eccentric members 152, 154, the vibration assembly 150 can include a drive motor 174 mounted to the framework 170. The drive motor 174 can be a hydraulically activated motor, an electromagnetically activated motor, or can be powered by some other method. In the illustrated embodiment, the drive motor 174 is oriented toward the first end 136 of the roller drum and is co-axial with the drum axis 134, but in other embodiments the drive motor could be disposed at other positions within the interior volume 132. The drive motor 174 includes a rotatable drive shaft 176 that can define a drive motor axis 178. In FIG. 2, the drive motor axis 178 is parallel to and indicated by dashed lines superimposed over the drum axis 134. In this orientation, the drive motor axis 178 is perpendicular to the first and second eccentric axes 164, 166.

To redirect the rotational force delivered by the drive motor 174, the vibration assembly 150 may have a drive train that includes a first bevel gear 180 disposed on the end of the drive shaft 176. The first bevel gear 180 cooperates or engages with a second bevel gear 182 disposed on the lower end of the first eccentric shaft 160. As will be appreciated by those of skill in the art, cooperation between the first and second bevel gears 180, 182 re-orientates the rotational force from the drive motor 174 approximately 90° degrees from rotation with respect to the drive motor axis 178 to rotation with respect to the first eccentric axis 164. Operation of the drive motor 174 thereby causes rotation of the first eccentric member 152 with respect to the first eccentric axis 164. To communicate the rotational force to the second eccentric member 154, a first transmission gear 184 can be disposed on the lower end of the first eccentric shaft 160 and can cooperatively engage a second transmission gear 186 on the lower end of the second eccentric shaft 162. The first and second transmission gears 184, 186 may be identical with the same diameter and number of teeth so that the rotational speed of the first and second eccentric members 152, 154 in RPMs is identical and maintained in sync. In other embodiments, the vibration assembly can be belt-driven utilizing drive belts to transmit the rotational force from the drive motor to the eccentric members.

To maintain the vertical and perpendicular orientation of the first and second eccentric members 152, 154 with respect to the surface 102 and the drum axis 134 as the roller drum 120 rolls over the surface, the roller drum may be enabled to rotate about the drum axis independently of the vibration assembly 150. This can be accomplished by a bearing assembly 190 that supports the vibration assembly 150 within the interior volume 132 of the roller drum. The bearing assembly 190 includes a first assembly bearing 192 disposed toward the first end 136 of the roller drum 120 that attaches to and connects the framework 170 and the internal structure of the drum shell 130. A second assembly bearing 194 disposed toward the second end 138 of the roller drum 120 also connects the framework 170 and the internal structure of the drum shell 130. This arrangement allows for independent rotation of the roller drum 120 about the internally situated but comparatively stationary vibration assembly 150.

Figure 3:
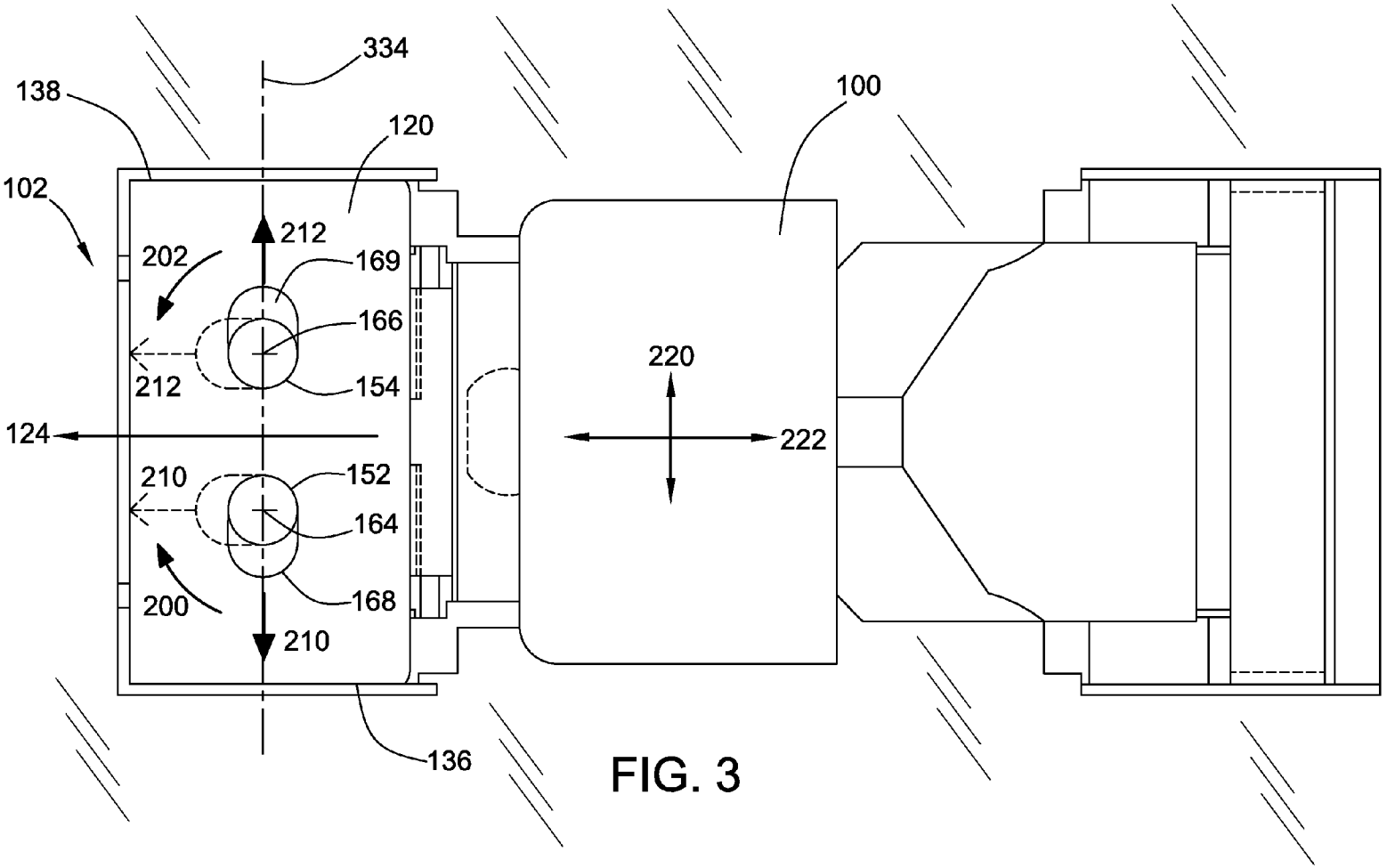
FIG. 3 is a top plan view of the vibratory compactor illustrating the directions in which the vibratory forces may combine or cancel.

Referring to FIG. 3, when the drive motor is activated it will cause the first and second eccentric members 152, 154 to rotate about their respective first and second eccentric axes 164, 166 and with respect to each other and to the roller drum 120. The speed of rotation, or angular velocity w, can be determined by the speed of the drive motor and the gear ratio between the bevel gears and/or transmission gears. The transmission gears can be set so that the first and second eccentric members rotate in opposite rotational directions, i.e., clockwise and counter-clockwise, as indicated by arrows 200, 202. In the embodiments where the transmission gears are identical in order to produce synced rotation, both the first and second eccentric members will spin at the same angular velocity w. The eccentric members 152, 154 can be arranged 180° out of phase with each other such that when the first eccentric mass 168 is directed toward the first end 136 of the roller drum 120, the second eccentric mass 169 is directed toward the opposite second end 138. Because the transmission gears spin both eccentric members at the same angular velocity w, the first and second eccentric members are locked into the 180° phase relationship.

Because the eccentric masses 168, 169 are radially offset from the respective first and second eccentric axes 164, 166, the eccentric members 152, 154 are unbalanced and their rotation will produce a moment or centripetal force, herein referred to as an eccentric force. The eccentric force is generally a function of Equation (1):

$$F=m*r*\omega^2 \quad (1)$$

Wherein m is the eccentrically offset mass, r is the distance between the center of mass of the offset eccentric mass and the eccentric axis of the eccentric shaft, and ω as stated above is the angular velocity. Rotation of the first eccentric member 152 produces a first eccentric force 210 and rotation of the second eccentric member produces a second eccentric force 212. The direction of the eccentric forces 210, 212 is radially outward from the respective first and second eccentric axes 164, 166 and angularly changes with the angular position of the first and second eccentric masses 168, 169. Hence, as the angular position of the first eccentric mass 168 rotates 90° from a first position indicated by solid lines to a second position indicated by dashed lines, the direction of the first eccentric force 210 likewise changes as also indicated by dashed lines. As illustrated in FIG. 3, the same angular change occurs with respect to the second eccentric mass 169 and second eccentric force 212.

Because the first and second eccentric members 152, 154 are in a phase relationship in which they are 180° out of phase with one another, the first and second eccentric forces 210, 212 can combine or counteract with one another depending upon the angular orientation of the eccentric members. For example, when the first and second eccentric members 152, 154 are in the first position indicated by solid lines in FIG. 3, the first and second eccentric forces 210, 212 are in opposite directions and cancel each other. In this position, the directions of the eccentric forces 210, 212 are parallel to the drum axis 134 and perpendicular to the direction of travel 124 of the compactor. The canceling eccentric forces 210, 212 thereby generate a reduced or minimum vibratory force 220, represented as an arrow, that is generally traverse to the direction of travel 124.

When the first and second eccentric members 152, 154 rotate to the second position indicated by dashed lines in FIG. 3, the first and second eccentric forces 210, 212 align together in the same, parallel direction and combine with each other. In this position, the direction of the eccentric forces 210, 212 is also parallel to the direction of travel 124 but perpendicular to the drum axis 134. Hence, the combining first and second eccentric forces 210, 212 generate an increased or maximum vibratory force 222, also represent as an arrow, generally along the direction of travel 124. As the first and second eccentric members 152, 154 rotate another 90° so that the first and second eccentric masses 168, 169 are directed toward each other, it will be appreciated that the eccentric forces 210, 212 again cancel each other and produce a reduced or minimum vibratory force parallel to and aligned along the drum axis 134. Hence, as the eccentric members 152, 154 rotate by 90° angular increments, they alternately cancel and combine to generate minimum or maximum vibratory forces.

Table 1 represents the angular position of the eccentric members and the generation of the vibratory force at each position and in the various directions with respect to the compactor machine. In Table 1, the first position represents the first position of the eccentric members 152, 154 indicated by solid lines in FIG. 3 and the second position represents the second position of the eccentric members indicated by dashed lines.

TABLE 1

| Position | First | Second | Third | Fourth |
|---|---|---|---|---|
| Angular Position | 0° | 90° | 180° | 270° |
| Eccentric Forces | Cancelled | Combined | Cancelled | Combined |
| Vibratory Force | Minimum | Maximum | Minimum | Maximum |
| Direction of Vibratory Force | Parallel to Drum Axis | Parallel to Direction of Travel | Parallel to Drum Axis | Parallel to Direction of Travel |

Referring to FIGS. 2 and 3, the continued and constant rotation of the eccentric members 152, 154 in synch with each other will generate harmonic, oscillating vibratory forces within the roller drum 120 which are imparted to the surface 102 over which the roller drum travels. As the eccentric members rotate in phase through a 360° rotation, the generated vibratory forces will oscillate through one complete phase or period and thus the vibratory forces can be represented as a sinusoidal, harmonic function or curve. The speed or frequency ω of the harmonic vibratory forces is directly related to the speed of the drive motor and can be adjustably controlled by the onboard controller 118 illustrated in FIG. 1. The amplitude or magnitude of the vibratory forces are a function of the mass of the eccentric members and their offset distance from their respective eccentric axes.

Referring back to FIG. 2, to maintain the vibration assembly 150 in a stationary position as the roller drum 120 rotates about the drum axis 134, in an embodiment the vibration assembly can be fixedly connected to the frame of the compactor machine. In particular, the first flange leg 128 and second flange leg 129 can each include a respective first extension 140 and second extension 142 that extend into the interior volume 132 of the cylindrical roller drum 120 from the respective first end 136 and second end 138. The first extension 140 and the second extension 142 can attach to the framework 170 of the vibration assembly 150 by, for example, welding. Due to the fixed attachment, the vibration assembly 150 and the first and second vertically oriented eccentric members 152, 154 therein remain in fixed orientation as the drum shell rolls over the surface 102. In a further embodiment, the roller drum 120 can be rotatably coupled to the frame of the compactor machine by a first drum bearing 144 and a second drum bearing 146 that rotatably interconnects the internal structure of the drum shell 130 to the respective first and second flange legs 128, 129.

Figure 4:
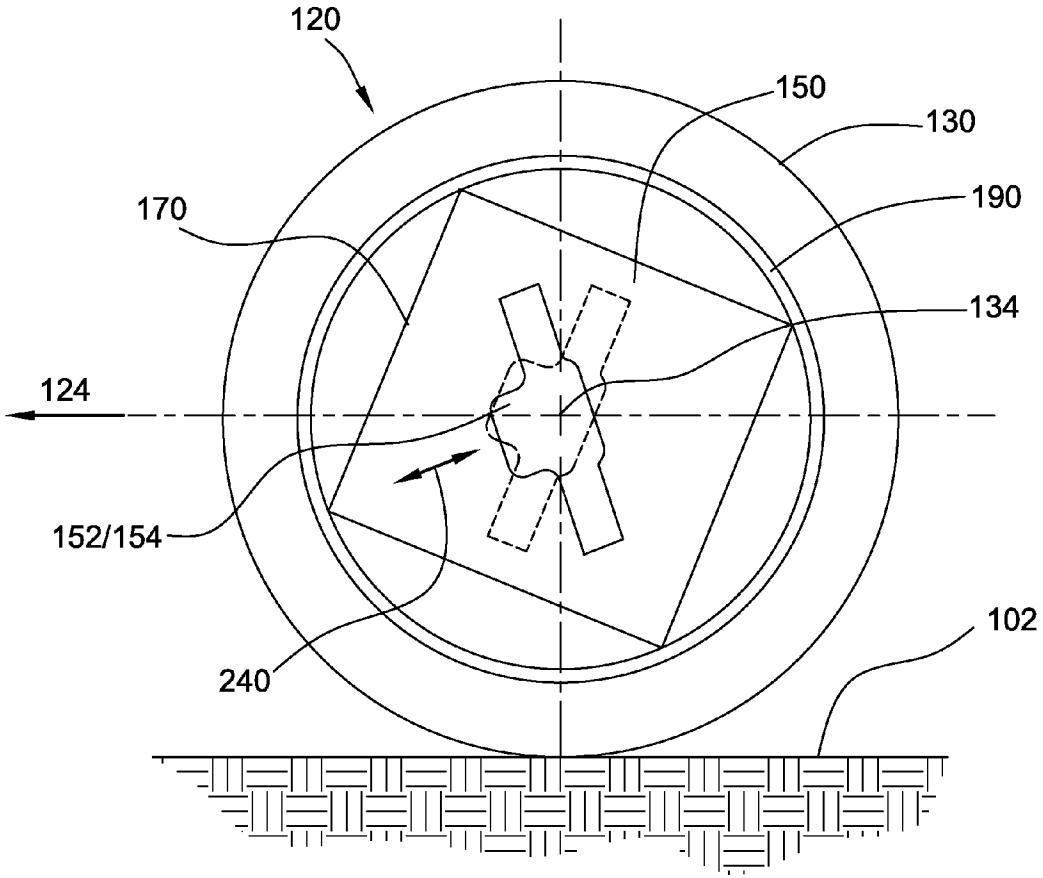
FIG. 4 is side plan view of another embodiment of the roller drum in which the vibration assembly may be pivoted in the roller drum to adjust the angular position of the vibratory forces.

In another embodiment, illustrated in FIG. 4, the vibration assembly 150, as opposed to being fixed to the frame of the compactor machine, can pivot about the drum axis 134 to adjust the angular position of the first and second eccentric members 152, 154 with respect to the surface 102. Because the framework 170 is connected to the bearing assembly 190, the bearing assembly can be made to pivot 10° or so with respect to the surface 102 such that the angular orientation of the first and second eccentric members 152, 154, shown in solid lines, are changed from being truly vertical to being partially directed toward the surface 102. In this position, the vibratory forces 240, represented as an arrow, generated by the eccentric members 152, 154 are no longer perfectly aligned with the direction of travel 124 but can include or generate a component that is angularly directed toward the surface 102 in addition to a component aligned with the direction of travel. The bearing assembly 190 can maintain the eccentric members 152, 154 in this angular position as the drum shell 130 of the roller drum 120 continues to rotate around the drum axis 134 independently of the vibration assembly 150. In a further embodiment, the bearing assembly 190 can pivot the eccentric members 152, 154, illustrated in dashed lines, in the reverse angular direction so that the eccentric members can have an angular orientation with respect to the surface 102 of, for example, −10°.

Figure 5:
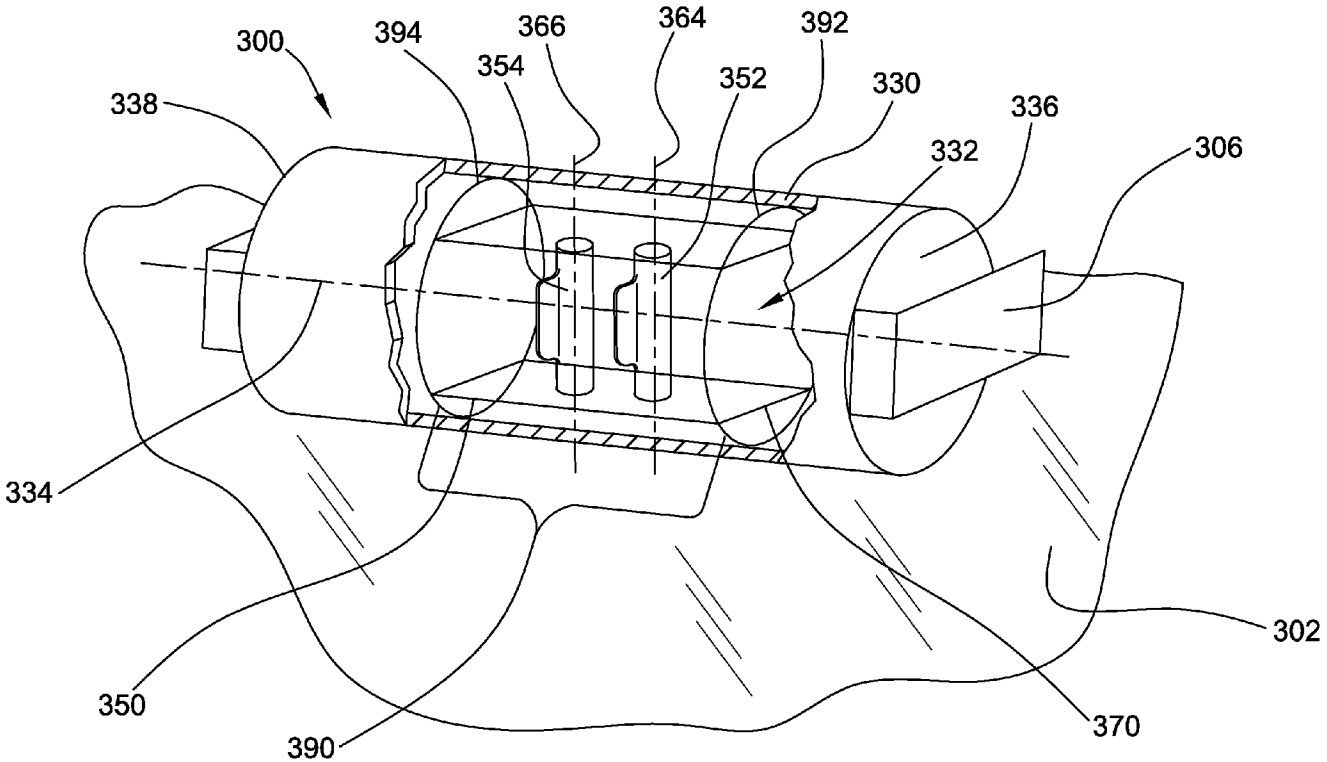
FIG. 5 is a perspective, cut-away view of another embodiment of a vibratory compactor designed to be pushed before or trailed behind a self-propelling machine.

In a further embodiment, illustrated in FIG. 5, the vibratory compactor 300 can be configured as a work tool attachment that can be attached to and either hauled behind or pushed forward of another self-propelling machine that travels over the surface 302 to be compacted. The vibratory compactor 300 includes an elongated cylindrical roller drum 320 that defines and can rotate about a drum axis 334. To attach the vibratory compactor 300 to the machine, a bifurcated attachment device 306 is included that extends around the first end 336 and second end 338 of the roller drum 320 and connects to the roller drum in a manner that enables the roller drum to rotate about the drum axis 334.

The vibration assembly 350 can also be disposed inside the interior volume 332 of the roller drum 320. The vibration assembly 350 includes a first eccentric member 352 and a second eccentric member 354 that are maintained in a vertical position with respect to the surface over which the roller drum 320 travels. The first eccentric member 352 defines a first eccentric axis 364 and the second eccentric member 354 includes a second eccentric axis 366. Due to the upright, vertical orientation of the first and second eccentric members 352, 354, the first and second axes 364, 366 are perpendicular to the drum axis 334 and the direction of travel 324 of the vibratory compactor 300. To enable the roller drum 320 to rotate about the drum axis 334 while maintaining the vertical orientation of the eccentric members 352, 354, a bearing assembly 390 is disposed inside the interior volume 332. The bearing assembly 390 includes a first assembly bearing 392 and a second assembly bearing 394 that connects the interior structure of the drum shell 330 with a framework 370 that in turn connects to the first and second eccentric members 352, 354. To rotate the first and second eccentric members 352, 354 and generate the vibratory forces, the vibratory compactor can include various gears, bearings and a drive motor as described above.

INDUSTRIAL APPLICABILITY

As explained above, the present disclosure is applicable to compacting and densifying a loose material such as freshly spread asphalt disposed over a surface. Referring to FIG. 3, the compactor machine 100 can travel over the surface 102. As the compactor machine 100 travels the forward roller drum 120 which is in rolling contact with the surface 102 rotates about the drum axis 134 that is orientated perpendicularly to the direction of travel 124. The vibrator assembly 150 is disposed inside the rotating roller drum 320 and includes the vertical first and second eccentric members 152, 154 whose respective first and second eccentric axes are perpendicular to the drum axis 134. The vertical orientation of the first and second eccentric members 152, 154 is maintained as the roller drum 120 independently rotates about the vibrator assembly 150.

As the eccentric members 152, 154 rotate or spin around their respective eccentric axes, they produce the centripetal forces or eccentric forces 212, 210 that combine or cancel so as to generate alternating increased or reduced, i.e., maximum or minimum, vibratory forces within the roller drum 120. The increased or maximum vibratory force 222 is aligned and parallel with the direction of travel 124. It will be appreciated that aligning the maximum vibratory force along the direction of travel 124 will create a general forward-and-reverse, or back-and-forth, vibrations in the roller drum 120 that will in turn impart the same vibrations to the surface 102. Back-and-forth vibrations are beneficial in compacting asphalt, soil, and similar materials as they tend to both shift back and forth and compress downward the loose material with respect to the surface. Hence, the asphalt tends to densify in multiple directions.

The reduced or minimum vibratory force 220, in contrast, is aligned and parallel with the drum axis 134 and therefore perpendicular to the direction of travel 124. Aligning the minimum vibratory force with the drum axis 134 minimizes the side-to-side vibrations or forces imparted to the roller. This is may be beneficial in maintaining the structural integrity of the compactor machine 100 because such side-to-side vibrations tend to be damaging to the machine. For example, referring to FIG. 2, the side-to-side movement may damage the bearings 144, 146 that rotatably connect the roller drum 120 with the first flange leg 128 and the second flange leg 129. Additionally, it will be appreciated that the side-to-side vibrations may detract the compactor machine from the intended direction of travel 124 that is typically perpendicular to the side-to-side vibrations. Reducing or minimizing the vibratory forces in the side-to-side direction can therefore improve the longevity of the compactor machine.

Referring to FIG. 4, it will be appreciated that pivoting the vibration assembly 150 with respect to the drum axis 134 directs the vibratory forces 240 both in the back-and-forth direction and downwards toward the surface. Hence, the vibration forces 240 provide both a shifting motion and a compressing force to the loose material being compacted while still reducing side-to-side vibrations.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A vibratory compactor machine comprising:

a machine frame;

at least one cylindrical roller drum rotatably coupled to the machine frame and rotatable about a drum axis oriented generally transverse to a direction of travel of the vibratory compactor machine; and a vibration assembly disposed inside the roller drum, the vibration assembly including a first eccentric member and a second eccentric member, the first eccentric member rotatably disposed in the roller drum about a first eccentric axis and the second eccentric member rotatably disposed in the roller drum about a second eccentric axis, the first eccentric axis and the second eccentric axis oriented generally perpendicularly to the drum axis, wherein the roller drum rotates about the drum axis independently with respect to the vibration assembly including the first eccentric member and the second eccentric member.

2. The vibratory compactor machine of claim 1, wherein the first eccentric axis and the second eccentric axis are parallel to each other.

3. The vibratory compactor machine of claim 2, wherein the cylindrical drum roller includes a first end and an opposite second end, the drum axis extending between the first and second ends.

4. The vibratory compactor machine of claim 3, wherein the first eccentric member and the second eccentric member are axially spaced apart with respect to the drum axis and with the first eccentric member disposed toward the first end of the roller drum and the second eccentric member disposed toward the second end of the roller drum.

5. The vibratory compactor machine of claim 4, wherein the first eccentric member and the second eccentric member rotate about the first eccentric axis and the second eccentric axis, respectively, in opposite directions of each other.

6. The vibratory compactor machine of claim 5, wherein rotation of the first eccentric member produces a first eccentric force and rotation of the second eccentric member produces a second eccentric force, and the first eccentric member and the second eccentric member are in a phase relationship such that the first eccentric force and the second eccentric force generate a combined vibratory force generally along the direction of travel.

7. The vibratory compactor machine of claim 6, wherein the phase relationship between the first eccentric member and the second eccentric member is such that the first eccentric force and the second eccentric force cancel in a direction generally transverse to the direction of travel and parallel to the drum axis.

8. The vibratory compactor machine of claim 1, further comprising a bearing assembly supporting the vibration assembly within the roller drum enabling independent rotation of the roller drum about the vibration assembly.

9. The vibratory compactor machine of claim 8, wherein the vibration assembly further comprises a drive motor for rotating the first eccentric member and the second eccentric member.

10. The vibratory compactor machine of claim 9, wherein the drive motor defines a motor rotation axis that is generally parallel to the drum axis and generally perpendicular to the first eccentric axis and the second eccentric axis, the drive motor drives a first bevel gear that operably cooperates with a second bevel gear on the first eccentric member.

11. The vibratory compactor machine of claim 10, wherein the first eccentric member includes a first transmission gear operably cooperating with a second transmission gear on the second eccentric member to rotate the second eccentric member.

12. The vibratory compactor machine of claim 11, wherein the vibration assembly can pivot via the bearing assembly to adjust an angular orientation of the first eccentric axis and the second eccentric axis with respect to the direction of travel.

13. A method of compacting a surface, the method comprising:

providing a vibratory compactor machine including a cylindrical roller drum in rolling contact with the surface, the roller drum rotatable about a drum axis oriented generally perpendicular to a direction of travel of the vibratory compactor machine;

disposing a vibration assembly inside the roller drum; the vibration assembly including a first eccentric member rotatable about a first eccentric axis and a second eccentric member rotatable about a second eccentric axis, the first eccentric axis and the second eccentric axis oriented generally perpendicular to the drum axis;

rotating the roller drum independently about the vibration assembly;

inducing a vibratory force to the roller drum along the direction of travel by rotating the first eccentric member and the second eccentric member.

14. The method of compacting of claim 13, further comprising:

rotating the first eccentric member about the first eccentric axis to produce a first eccentric force; and rotating the second eccentric member about the second eccentric axis in an opposite direction to produce a second eccentric force.

15. The method of compacting of claim 14, further comprising phasing rotation of the first eccentric member and the second eccentric member so that the first eccentric force and the second eccentric force induce a combined vibratory force generally along the direction of travel.

16. The method of compacting of claim 15, further comprising phasing rotation of the first eccentric member and the second eccentric member so that the first eccentric force and the second eccentric force cancel in a direction generally transverse to the direction of travel and parallel to the drum axis.

17. The method of compacting of claim 13, further comprising pivoting the vibration assembly to adjust an angular orientation of the first eccentric axis and the second eccentric axis with respect to the surface.

18. A vibratory compactor for compacting a surface, the vibratory compactor configured for permanent or detachable connection with a machine adapted to travel over the surface, the vibratory compactor comprising:

a cylindrical roller drum for rolling contact with the surface, the roller drum rotatably coupled to a frame connectable to the machine, the roller drum rotatable about a drum axis oriented generally transverse to a direction of travel of the machine;

a vibration assembly disposed inside the roller drum, the vibration assembly including a first eccentric member rotatable about a first eccentric axis to produce a first eccentric force and a second eccentric member rotatable about a second eccentric axis to produce a second eccentric force, the first eccentric axis and the second eccentric axis oriented generally perpendicular to the drum axis and to the direction of travel;

a bearing assembly supporting the vibration assembly and enabling respective independent rotation of the roller drum about the vibration assembly to substantially maintain perpendicular orientation of the first eccentric axis and the second eccentric axis with respect to the drum axis and the direction of travel.

19. The vibratory compactor of claim 18, wherein the first eccentric member and the second eccentric member rotate in a phase relationship with each other and in opposite directions to each other such that the first eccentric force and the second eccentric force combine to generate a combined vibratory force generally along the direction of travel and cancel in a direction generally transverse to the direction of travel.

20. The vibratory compactor of claim 19, wherein combined vibratory force oscillates along the direction of travel as the first eccentric member and the second eccentric member rotate approximately 180° about the respective first and second axes.

* * * * *